US005613746A

United States Patent [19]

Green et al.

[11] Patent Number: 5,613,746

[45] Date of Patent: Mar. 25, 1997

[54] DESK ASSEMBLY

[75] Inventors: Patrick M. Green, Maryville; Robert Huerto, Farragut, both of Tenn.

[73] Assignee: Rubbermaid Office Products Inc., Maryville, Tenn.

[21] Appl. No.: 386,265

[22] Filed: Feb. 9, 1995

[51] Int. Cl.[6] ..... H47B 17/00; H47B 27/00

[52] U.S. Cl. ..... 312/194; 312/111; 312/195; 220/62; 220/6; 108/157

[58] Field of Search ..... 312/195, 194, 312/108, 111, 258; 220/62, 62.1, 6; 108/156, 157

[56] References Cited

U.S. PATENT DOCUMENTS

| | | | |
|---|---|---|---|
| D. 350,247 | 9/1994 | Buske . | |
| 2,276,374 | 3/1942 | Derman . | |
| 2,859,905 | 11/1958 | Choate . | |
| 3,353,888 | 11/1967 | Pritelli . | |
| 3,434,769 | 3/1969 | Salet . | |
| 3,727,825 | 4/1973 | Troth . | |
| 4,082,214 | 4/1978 | Baker . | |
| 4,386,926 | 6/1983 | Heller . | |
| 4,408,812 | 10/1983 | Kraufwurst | 312/111 |
| 4,443,046 | 4/1984 | Hannah . | |
| 4,632,345 | 12/1986 | Barley . | |
| 4,717,214 | 1/1988 | Moore et al. | 312/258 |
| 4,819,567 | 4/1989 | Thompson et al. | 312/111 |
| 4,896,790 | 1/1990 | Gronnevik . | |
| 5,033,669 | 7/1991 | Federico . | |
| 5,147,270 | 9/1992 | Grennevil . | |
| 5,184,772 | 2/1993 | McGrath . | |
| 5,295,632 | 3/1994 | Zink et al. . | |
| 5,368,380 | 11/1994 | Mottmiller et al. | 312/111 |
| 5,382,087 | 1/1995 | Pouch | 312/258 |

FOREIGN PATENT DOCUMENTS

| | | | |
|---|---|---|---|
| 2417240 | 10/1970 | France | 312/111 |
| 2908838 | 9/1980 | Germany | 220/62 |

*Primary Examiner*—Peter M. Cuomo
*Assistant Examiner*—Anthony D. Barfield
*Attorney, Agent, or Firm*—Richard B. O'Planick; Lisa B. Riedesel

[57] ABSTRACT

A desk assembly (10) is disclosed comprising first and second pedestal units (12, 14), each comprising first and second side panels (18,20), first and second edge panels (30,32), and a frontward panel (22), with corner posts (34,36) formed interposed between the edge and side panels, and the side and frontward panels. The pedestals are integrally formed as a coplanar form with elastomeric hinges (42, 44, 46, and 48) formed to connect the corner posts to the edge, side, and frontward panels. The pedestal units are reconfigured from the flat manufactured form into a box form by pivotal movement of the side and edge panels, facilitated by the elastomeric hinges. The pedestal units further include a back panel (28) that attaches to back surfaces of the edge panels (30,32) to connect the edge panels together and to maintain the pedestal unit in its box form. A shelf panel (26) and bottom panel (24) are inserted into each pedestal unit during its reconfiguration, and held in position by grooves and sockets within the side, frontward, and edge panels, and the corner posts. The pedestal units are assembled to the underside (132) of a top panel (16) to fixedly support the panel (16) as a desk surface. Attachment of the components together is accomplished by dovetail projections (60) and projection-receiving dovetail sockets (114,134).

20 Claims, 6 Drawing Sheets

DESK ASSEMBLY

FIELD OF THE INVENTION

The subject invention relates generally to four sided enclosures suitable for a variety of uses and, in particular, to the use of such enclosures as pedestal supports for a desk assembly.

THE PRIOR ART

Desks are well-known consumer and commercial products. Typically, desks are either assembled by the manufacturer and transported in that condition to the purchaser, or sold in a disassembled condition for assembly by the end user. In the former situation, the transportation costs associated with shipping a bulky desk are a substantial component in the overall cost of the item.

In the latter situation, desks sold in the disassembled, or "knock-down" condition typically require a considerable amount of labor and time in assembly. This detracts from the commercial appeal of the product. In addition, the assembly of such desks involve a substantial number of fasteners and component parts, further complicating the manufacture, packaging, and transportation of the product for the manufacturer. This adds to the cost of the product as well as making the product cumbersome to assemble by the end user.

Commercially available desks that are sold in the disassembled state, and comprise a large number of component parts, some of which being substantial in size and weight. They are typically formed of wood or veneered particle board that results in a relatively heavy product. The packaging for such components is correspondingly large and burdensome to carry. The result is the consumer finds the package inconvenient to carry because of its weight and size, and often finds the package too large to transport home.

SUMMARY OF THE INVENTION

The present invention overcomes the aforementioned deficiencies in commercially available desk assemblies by providing a desk assembly of relatively few component parts, capable of inexpensive manufacture from light weight materials, assembled without fasteners or tools, and that is transportable in a flat, relatively small package. The desk assembly comprises two identical pedestal units, each of which having an integral body of plastic molded in a substantially flat condition. The body comprises first and second side panels positioned along an inside edge to a central rearward panel. Edge panels are integrally molded adjacent to the outside edges of the side panels. Interposed between the edge panels and the side panels, and between the side panels and the rearward panel, are integrally molded corner posts connecting with the edge panels, side panels, and rearward panel by elastomeric hinges that are integrally formed with the body.

The pedestal body is transformed from the flat manufactured form into an upright enclosure by folding the side panels into a normal relationship to the rearward panel, and the edge panels into a normal relationship to the side panels. A front panel member attaches to connect the edge panels together, and form a four-sided enclosure. A shelf and a bottom panel are captured by the side panels, corner posts, and rearward panel as the enclosure is formed and are accessible through central openings in the side panels, rearward panels, and front panel.

The pedestals are positioned in a spaced apart relationship and attach to the underside of a desk top component by means of projections formed in an upper surface of each pedestal unit. The resultant assembly is then inverted to provide a free standing desk unit.

Accordingly, it is an objective of the present invention to provide a desk assembly that is transportable in a knock-down form for subsequent assembly by an end user.

A further objective is to provide a desk assembly that is capable of assembly without hardware or tools.

Still a further objective is to provide a desk assembly that is transportable in a flat, compact configuration.

Yet a further objective is to provide a desk assembly that comprises relatively few parts, manufactured by conventional means from light-weight material.

Another objective is to provide a desk assembly that is composed entirely of plastic material, readily manufactured, and easily assembled by an end user.

These and other objectives, which will be apparent to one skilled in the art, are achieved by a preferred embodiment that is described below and which is illustrated by the accompanying drawings.

DESCRIPTION OF THE ACCOMPANYING DRAWINGS

FIG. 1 a perspective view of the assembled desk unit.

DESCRIPTION OF THE PREFERRED EMBODIMENT

Figure 1:
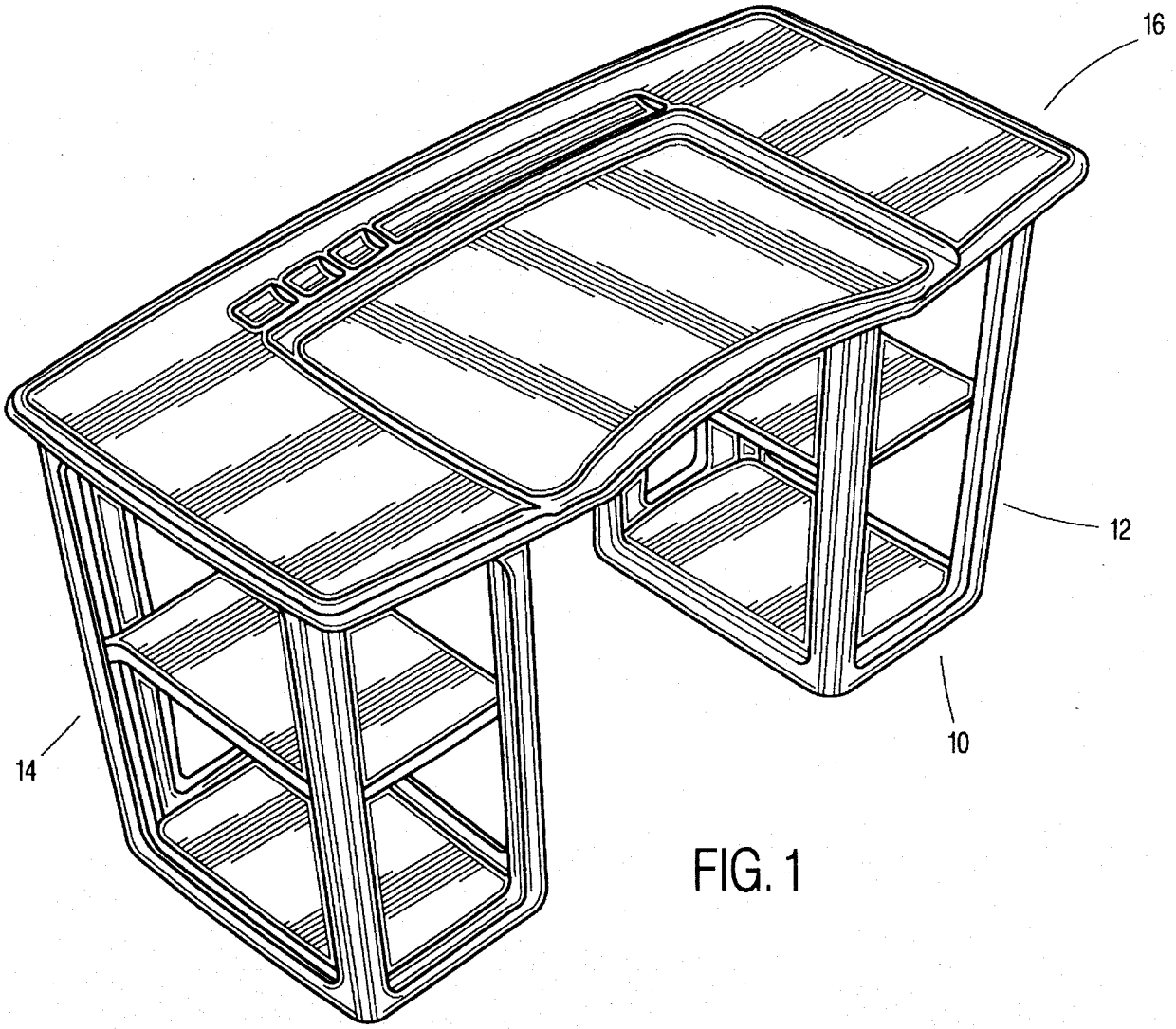
Figure 2:
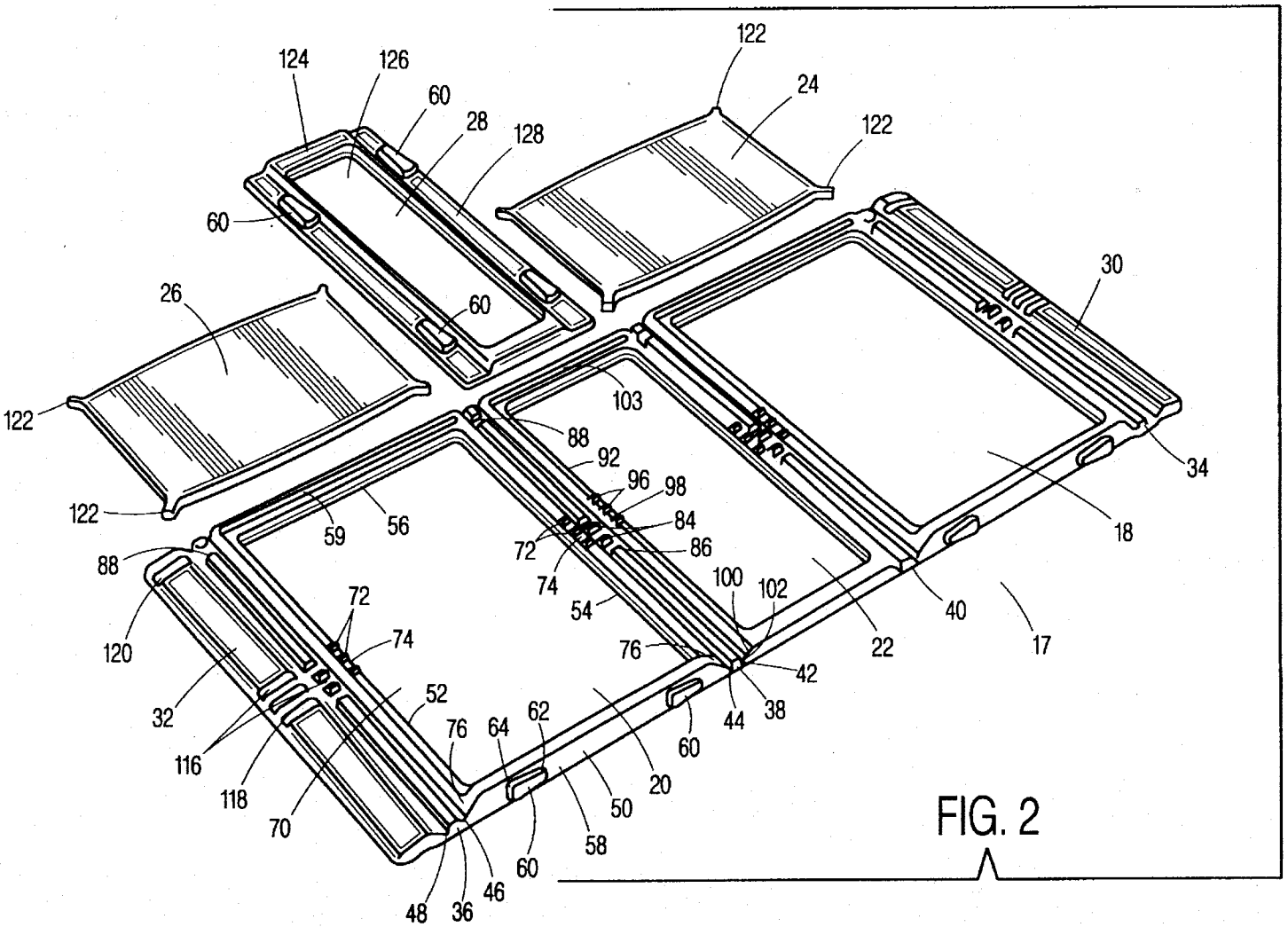
FIG. 2 is a perspective view of the pedestal unit in the disassembled condition.
Figure 6:
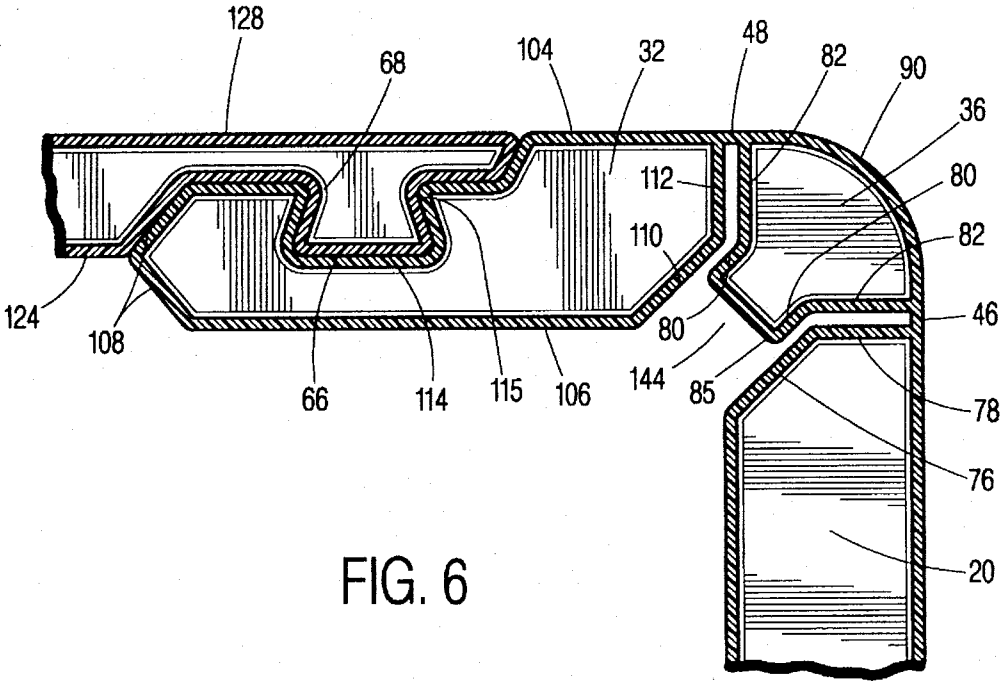
FIG. 6 is a sectional view through the edge panel, corner post, side panel, and front panel in the assembled condition.

Referring first to FIGS. 1, 2, and 6, the subject desk assembly 10 is shown to comprise a pair of pedestal components 12, 14 and a top panel 16 supported horizontally by the spaced apart pedestals. One of the two pedestal units 12, 14 is depicted in FIG. 2 in the unassembled state, it being understood that the following description of the one pedestal is applicable to the other.

The pedestal unit of FIG. 2 is shown as comprising a flat, integrally molded form 17 comprising three connected panels. A pair of side panels 18, 20 are joined along an inward edge to a forward panel 22. The form 17 is manufactured by a conventional plastic molding process such as blow-molding formation, and from conventional plastic material such as polyethylene.

In addition to the form 17, each pedestal unit consists of a bottom panel 24, a shelf panel 26, and a back panel 28 that are manufactured as separate components by conventional means such as blow-molding and from plastic material such as polyethylene. The shelf and bottom panels 24, 26 are identical components, made from the same mold, in order to minimize the cost of manufacture.

A pair of back edge panels 30, 32 are integrally formed as a portion of the form 17, each disposed along an outer edge of form 17. Rearwardly disposed corner posts 34, 36 are formed interposed between the edge panels 30, 32 and side panels 18, 20, respectively. Two frontward corner posts 38, 40 are likewise integral portions of the form 17, formed interposed between the side panels 18, 20 and the frontward panel 22. All four of the corner posts 34, 36, 38, 40 are of identical configuration, the depiction in section of post 36 in FIG. 6 being applicable to the other three posts.

Figure 3:
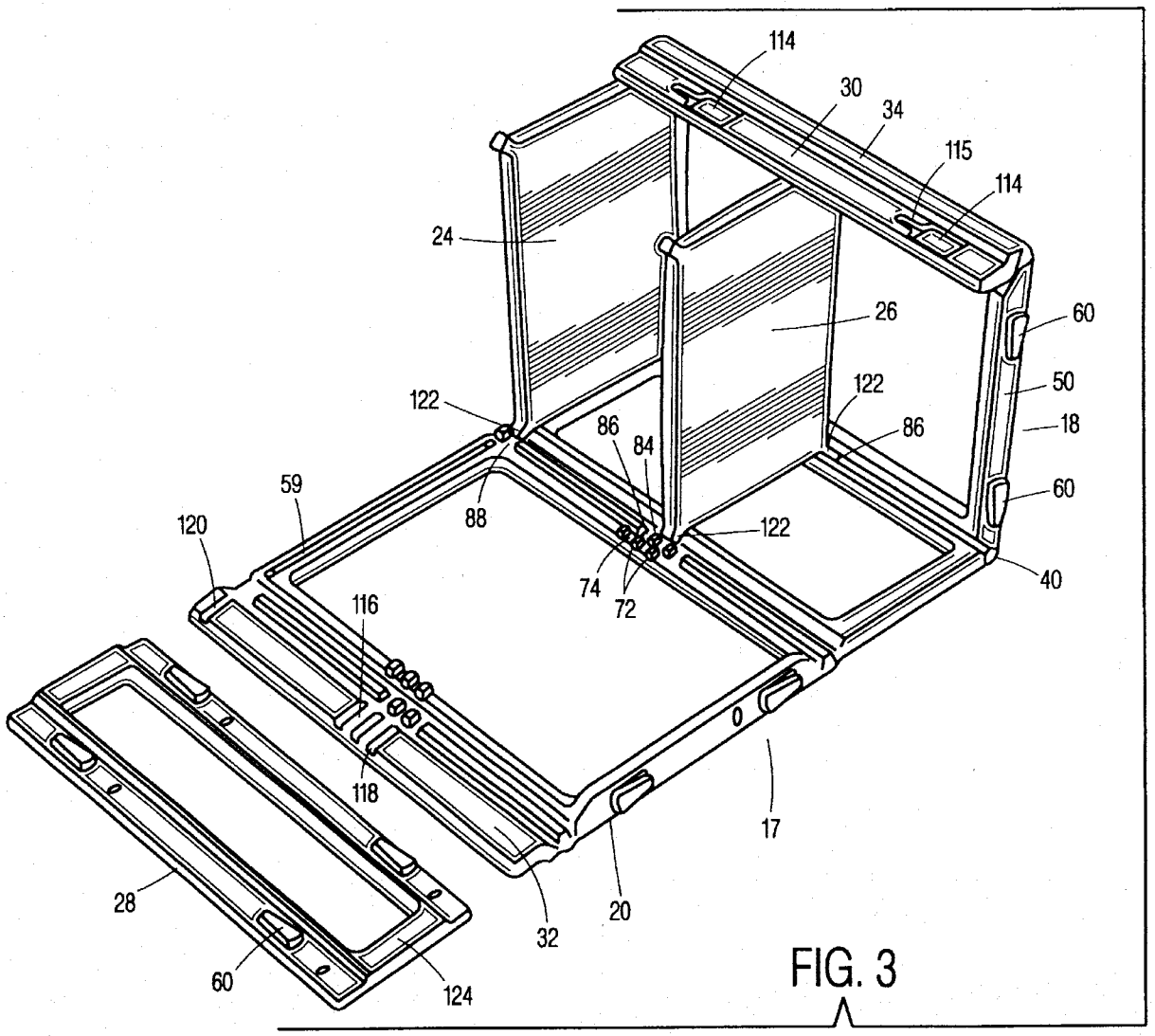
FIG. 3 is a top/back perspective view of the pedestal unit in a partially assembled condition.

The following description of the construction of the left side of the form 17, as viewed in FIG. 2, is equally applicable to the right side in as much as form 17 is symmetric about its transverse center axis. FIG. 3 shows the foreward corner post 38 is connected along opposite edges to the side panel 20 and the rearward panel 22 by flexible, elastomeric hinge portions 44, 42 respectively. As will be appreciated from FIG. 6, the elastomeric hinge portions of the subject invention are thin connective webs of plastic material that structurally connect portions of the form 17 together, but are flexible enough to allow subsequent movement of portions of form 17 relative to one another.

Similarly, the post 36 is formed to connect along a longitudinal edge with the side panel 20 and the back edge panel 32 by elastomeric hinge portions 46, 48 as shown in FIG. 6. The form 17 is manufactured in a flat configuration with the side panels 18, 20, the rearward panel 22, the back edge panels 30, 32, and the posts 34, 36, 38, and 40 lying in a common plane. The specific configuration of the components of form 17 will be described below with continued reference to FIGS. 1, 3, and 6.

As illustrated, the side panel 20 is constructed of a upper frame arm 50, side arms 52, 54, and a lower from arm 56. The upper frame arm 50 has an upper surface 58 from which two spaced apart, dovetail shaped projections 60 extend. The lower frame arm 56 has an internal ledge 59 that extends therealong for supporting the bottom panel 24 in a manner described below.

Each of the dovetail projections referred to in the subject disclosure are similar in configuration, as depicted generally in FIGS. 2–5 and in detail in FIG. 6. The projections each have a tapered end 62 and a wider end 64, and are configured to provide a relatively wide dovetail shaped flange 66 and a narrower neck portion 68 connecting the flange 66 to the surface from which it projects. From FIG. 2, it will be apparent that the tapered ends 62 of each projection on a panel surface are aligned to point in the same direction for assembly purposes.

Figure 7:
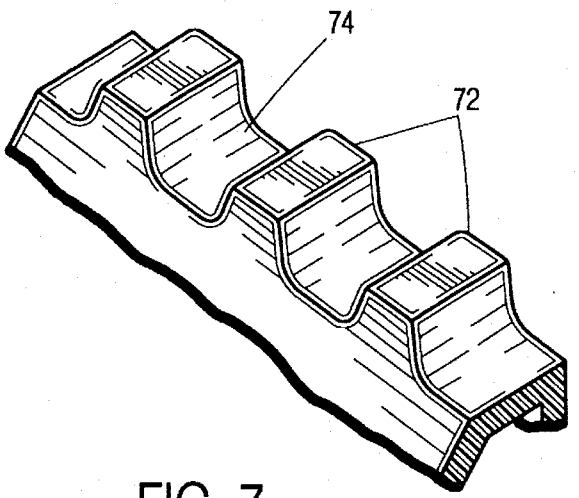
FIG. 7 is an enlarged perspective view of the ribs and grooves therebetween that receive and support the shelf panel.

Referring to FIGS. 2, 6, and 7, each of the panels 18, 20, and 22 are formed to provide a central rectangular opening 70. The side panels 18,20 are formed having three spaced apart ribs 72 configured as shown in FIG. 7, separated by grooves 74. The edge of the panel 20, as shown in FIG. 6 that is connected to the corner post 36 comprises two segments; a beveled innermost segment 76 and a vertical surface segment 78. The angle between surfaces 76, 78 is forty-five degrees.

The corner post 36 is configured to provide a vertical surface segment 82 at each side, and a beveled surface segment 80 at each side that intersects surfaces 82 at a forty-five degree angle. An inward facing surface 85 of each post that connects surfaces 80 extends the length of the post and is formed with three spaced apart flanges 84 midway of its length, the flanges 84 facing inward and being separated by socket depressions 86. At the bottom of each post is a single socket depression 88 extending into post surface 85 and opening inward. The external surface 90 of each post is radiussed and extends continuously from end to end of the post.

The frontward panel 22 is formed by side arms 92, 94, each side arm having at its lengthwise midpoint three inward facing ribs 96 that are shaped as shown in FIG. 7, separated by channels 98. The lateral edge surfaces of the rearward panel 22 are configured as shown in FIG. 6 for the side panel 20, namely as comprising a beveled edge surface portion 100 and a vertical surface portion 102. A ledge 103 is provided along a bottom side of the frontward panel 22 for supporting the bottom panel 24 in the manner described below.

With continued reference to FIGS. 2 and 6, the back edge panels 30,32 are each configured having an outer surface 104 and an inner surface 106, tapering to a pointed end 108. The back edge panel at a rearward end surface comprises a beveled surface portion 110 and a vertical surface portion 112 that intersect at a forty-five degree angle. The back edge panels have dovetail shaped upper and lower sockets 114 formed to extend into the outer surface 104, each socket peripherally defined by retention flange 115. The sockets are shaped as the dovetail projections described above, having a relatively wide portion and a narrow tapered portion. As shown in FIG. 3, the sockets are pointed downwardly in the same direction. As shown best by FIG. 2, the inward surface of the edge panels 30,32 are formed to provide at a midlength position two channels 118 separated by channel sides 116.

The bottom panel 24 and shelf panel 26 are identical, made from the same mold. Each is a flat rectangular body having an outward projecting corner peg 122 extending from each corner at a forty-five degree angle. The corner pegs 122 are of square cross-sectional configuration and are integrally formed with the main body of the panels.

Figure 4:
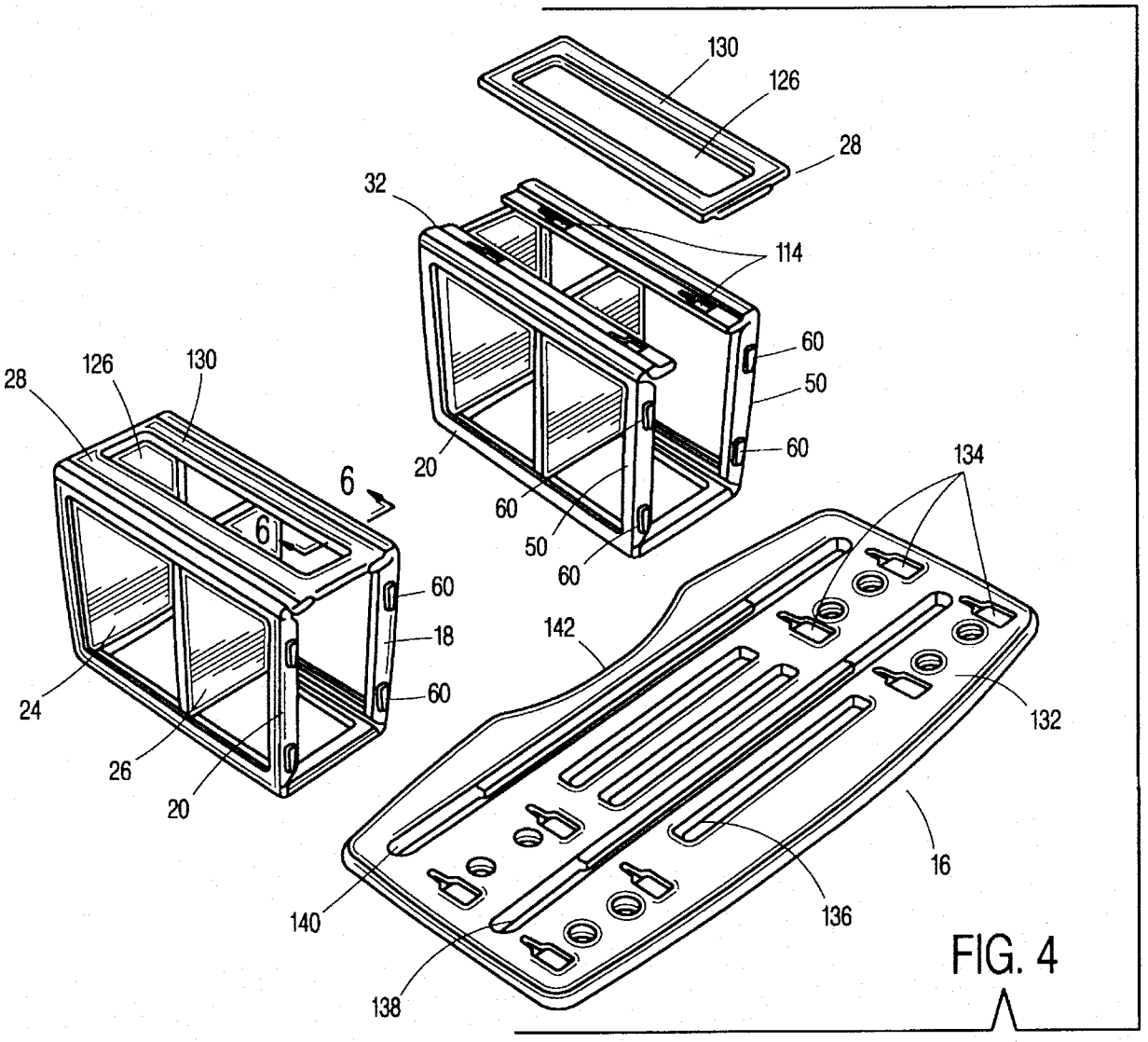
FIG. 4 is a perspective view of the pedestal units in a partially assembled condition and the desk top panel.

Referring now to FIGS. 2,4, and 6, the back panel 28 is of rectangular shape, comprising a body portion 124 having a rectangular central opening 126 extending therethrough. Outwardly stepped edge portions 128 extend along opposite sides of the body portion 124. A flat outward surface 130 extends peripherally about the central opening 126. Four of the dovetail projections are formed in the edge portions 128 as shown in FIG. 2, each of the projections tapering in the same upward direction.

Figure 5:
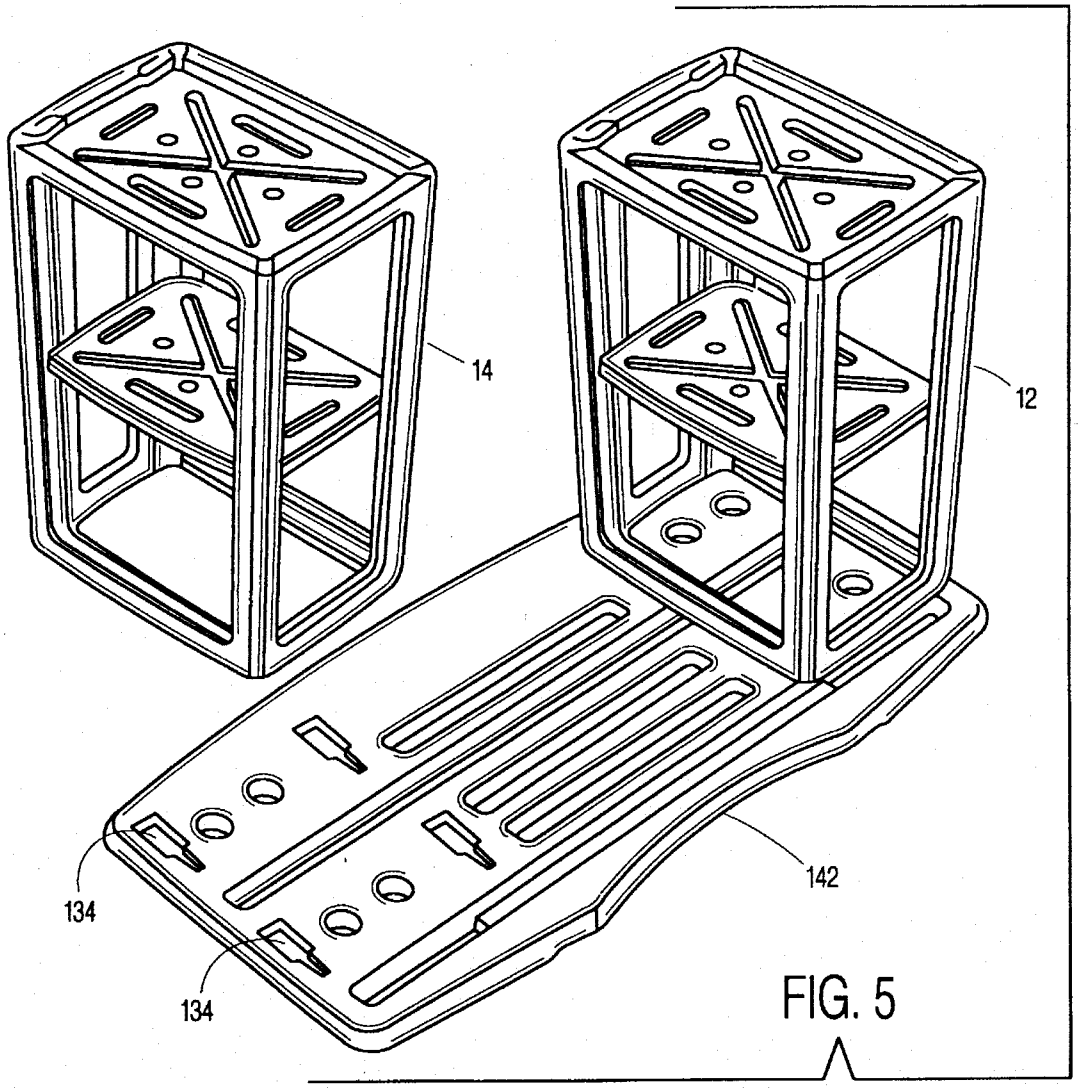
FIG. 5 is a perspective view of the desk top underside with one of the pedestal units assembled thereto and one pedestal unit to the side thereof.

The desk top panel 16 is shown to comprise a planar underside surface 132 into which four dovetail sockets 134 are formed at opposite ends of the surface 132. The sockets 134 each taper in the same rearward direction of the top panel as shown in FIGS. 4 and 5. Three longitudinal reinforcement grooves 136, 138, and 140 are formed to extend into the panel underside surface 132 and add rigidity to the panel 16. A concave recess 142 extends into a rearward edge of the panel 16, midway between its ends.

Referring to FIGS. 2, 3, 4, and 5, the sequential assembly of the subject desk assembly proceeds as follows. The component pans of each pedestal component are shown in FIG. 2. The form 17 is molded as one pan, and the back panel 28, and panels 24, 26 separately. The pans of each pedestal component and the desk top panel 16 are substantially flat and can be stacked and package into a flat, relatively small container. Moreover, the parts are composed solely of plastic and are relatively light weight, making the package in which they are shipped easy to carry and inexpensive to transport. The desk assembly comprises two pedestal units, each containing the four components shown in FIG. 2, and one desk top panel, for a total of nine pans. No assembly hardware or tools are necessary for assembly as will be appreciated. Assembly of the desk is intended to be performed by the end user.

The form 17 is reconfigured into the shape shown in FIG. 3 as side panel 18 is pivoted upward from a coplanar relationship with the rearward panel 20 into a normal relationship thereto. The bottom panel 24 and the shelf panel 26 are then positioned within the pedestal unit internal volume, as shown, the bottom panel rearward corner peg 122 inserted into the rearward corner post 40 bottom socket 88. The shelf panel frontward corner peg 122 is likewise inserted into the post 40, into one of the post sockets 86. The height of the shelf panel 26 is adjustable by the position of the post socket 86 along the post 40 into which it is inserted.

The back edge panel 30 is folded over the back side of the pedestal unit as shown in FIG. 3, with the back corner peg 122 of the bottom panel 24 inserted into the bottom post socket 88 of the forward corner post 34. The shelf panel forward corner peg 122 is inserted into the post 34, positioned within one of the post sockets 86. It will be appreciated that as the back edge panel 30 and the side panel 18 are conformed into ninety degree abutment, edges of the bottom panel 24 adjacent to the corner pegs enter into the groove 120 of the edge panel and rest upon the ledges 59 of the side panel and 103 of the forward panel 22. Also, edges of the shelf panel 26 adjacent to the corner pegs enter into the grooves 74 of the side panel and 98 of the forward panel 22. So positioned the bottom panel is fixed to the bottom of the pedestal unit and the shelf panel fixed at its intended height within the pedestal unit.

The opposite side panel 20 is then pivoted upward into a normal relationship to the rearward panel 22, and the edge panel pivoted into a normal relationship to panel 22. The opposite corner pegs 122 of the bottom panel 24 and the shelf panel 26 are captured by the opposite corner post sockets 88 and 86, and edges adjacent to the pegs 122 are captured by the side panel grooves 74 and grooves 98 of the frontward panel 22. Thus, the bottom panel and shelf panel have all four corner pegs held within corner post sockets and adjacent edges of the bottom and shelf panels supported by grooves of the side panels, edge panels, and rearward panel. The bottom and shelf panels are firmly supported by the side, edge, and rearward panels in a horizontal orientation.

Completion of the assembly of a pedestal unit is accomplished as indicated in FIG. 4, by attaching the back panel 28 to forward surfaces of the edge panels 30, 32 as follows. The projections 60 of the front panel are aligned with and inserted into the sockets 114 of the edge panels 30, 32. The back panel is then moved downward relative to the edge panels, causing the dovetail projections 60 to move within the sockets 114 until the dovetail flange 66 moves below and is entrapped by the socket retention flange 115. FIG. 6 illustrates in section the retention of the flange 66 within the socket 114. The back panel thereby is fixed to the forward surfaces of the edge panels and connects the edge panels together, preventing the pedestal box from departing from the configuration depicted.

The finally assembled pedestal unit is shown in FIG. 4. It will be noted that the offset in the edge portions and complimentarily offset edge portions of the front panel overlap to create a flat, smooth back side to the pedestal unit. It will further be noted that the corner posts fill the gap between the panels such that the corners of the pedestal have a finished, radiussed appearance. Also, from FIG. 6, the complimentarily beveled surfaces of the corner posts and adjacent panels create a lead in for the shelf and bottom panels. The lead in referred to is numbered 144 in FIG. 6.

Assembly of the pedestal units to the underside of the desk top is illustrated in FIGS. 4 and 5. The assembled pedestal unit is positioned against the desk top surface 132 with projections 60 inserted into the sockets 134. Relative movement of the pedestal units to the desk top panel 16 causes the dovetail projections to move within the sockets until the dovetail flanges 66 of the projections are entrapped by the socket retention flanges 115 in the same manner as described above for the forward panel-to-edge panel connection. When the pedestal projections are fully inserted into the sockets the pedestals are fixed to the bottom of the desk top. Assembly is thereby completed and the desk may be inverted into the upright position depicted in FIG. 1.

From the foregoing, it will be appreciated that the subject assembly comprises relatively few parts that can be economically and readily manufactured. The parts can be packaged and shipped in a compact package and, because they are entirely formed of plastic, are relatively light. Moreover, no assembly hardware or tools are required.

The elastomeric hinges 42, 44, 46, 48 connecting the corner posts to the edge panels, side panels, and rearward panel are integrally formed as part of the formation of form 17. They facilitate a hinging of the panels together and allow manufacture of the panels intact, increasing efficiency of manufacture and minimizing cost. Also, the integral formation of support ribs and channels in the panels serve to rigidly support the shelf and bottom panels.

Finally, the windows or openings in the front, side, and rearward panels make the shelf and bottom panel top surfaces accessible by the user from any direction. Thus, access to items stored upon such surfaces is readily achieved, enhancing the utility of the desk assembly.

While the above describes a preferred embodiment of the present invention in a preferred application as a desk assembly, the invention is not intended to be restricted thereby. Other embodiments for other applications, that utilize the teachings herein set forth, are intended to be within the scope and spirit of the invention.

By way of example, the pedestal units in a broader sense are enclosures having four sides, created by the pivoting of the edge panels and side panels from a coplanar into a perpendicular orientation. The enclosure formed thereby can have application as a building frame, with the panels forming the sides of a four sided building. Alternatively, the enclosure and desk top could be modified to provide a work bench. Still further, the enclosure can provide the superstructure of a cart and, by applying casters to the bottom of the corner posts, a mobile cart can be created that can be shipped in a flat form and that has all of the same advantages attendant the practice of the present invention as a desk assembly.

The aforementioned alternative uses of the subject invention are intended to be only several examples of alternative configurations. Other uses and functions, that will be apparent to those skilled in the art, are intended to be likewise within the scope of the invention.

We claim:

1. A four-walled enclosure comprising:

two side panels and an intermediate panel that defines a front panel integrally formed in a flat, coplanar blank from elastomeric material, and the two side panels connect to the opposite sides of the front panel by a flexible hinge portion of reduced section material, and the two side panels pivot from an initial coplanar relationship with the front panel into a second position wherein the two side panels intersect the front panel at a substantially ninety degree angle and define therewith an internal storage compartment;

the side panels each having a back edge panel connected by elastomeric hinge means to a rearward edge of the side panel and each edge panel pivots from an initial coplanar relationship with the side panel into a second position intersecting the side panel at a substantially ninety degree angle; and a back panel connected to a back side of each of the edge panels to secure the edge panels and the side panels in their respective second positions and enclose a rearward side of the storage compartment.

2. An enclosure according to claim 1, wherein further comprising two forward corner posts, the forward corner posts each disposed between a frontal edge of a respective side panel and an adjacent outer edge of the front panel and the forward corner posts each have opposite outward edges connected by elastomeric hinges of reduced sectional thickness to the adjacent edges of the respective side panel and front panel and occupy a front corner of the enclosure when the side panels are pivoted into their respective second positions.

3. An enclosure according to claim 2, wherein the frontal edge of each of the side panels and the outer edges of the front panel are beveled and oppose complimentary beveled front corner post edge surfaces when each side panel is pivoted into the second position.

4. An enclosure according to claim 3, wherein further comprising a bottom panel positioned between the side panels, the front panel, and the back panel and engaging the side panels to enclose a lower side of the internal storage compartment.

5. An enclosure according to claim 4, wherein further comprising a top panel connected to an upper edge surface of each of the side panels, whereby enclosing a top side of the internal storage compartment.

6. An enclosure according to claim 5, wherein the upper edge surface of the side panels have integrally formed, upwardly directed, protrusions and the top panel has socket recesses formed therein to receive the side panel protrusions.

7. An enclosure according to claim 6, wherein the protrusions each comprise an outermost dovetail-shaped flange, a connecting neck portion joined at a remote end to an underside of the dovetail flange and connected at an inward and to the side panel upper edge surface, and the socket recesses each have a dovetail-shaped opening for receipt of the dovetail flange and upper peripheral opening edges for capturing the dovetail flange within the recess.

8. An enclosure according to claim 7, wherein at least one side panel of the enclosure has a central opening therethrough communicating with the storage compartment of the enclosure and the enclosure further comprising at least one shelf panel supported in a horizontal orientation by the corner posts of the enclosure.

9. A desk assembly comprising:

first and second pedestals, each pedestal comprising two side panels and an intermediate panel forming a front panel of the pedestal integrally formed in a flat, coplanar blank from plastic material, and the two side panels are connected to first and second opposite edges of the front panel by a flexible hinge portion of reduced section plastic material, and the two side panels pivot from an initial mutually coplanar relationship with the front panel into a second position wherein the two side panels intersect the front panel at a substantially ninety degree angle and define therewith an internal storage compartment;

the side panels each have a rearward edge panel connected by elastomeric hinge means to a rearward edge of the side panel and each edge panel pivots from an initial mutually coplanar relationship with its respective side panel into a second position intersecting the respective side panel at substantially a ninety degree angle;

a rearward panel connected to a rearward side of each of the edge panels to secure the edge panels and the side panels in their respective second positions; and a top work surface panel connected to an upper surface of the side panels in a horizontal orientation.

10. A desk assembly according to claim 9, wherein each of the pedestals have first and second front corner posts, the front corner posts being disposed between a from edge of a respective side panel and an adjacent outer edge of the front panel, and the front corner posts each have opposite outward first and second edges connected by elastomeric webs of plastic material to the adjacent edges of the side panel and the front panel and occupy a respective from corner of the pedestal when the side panel is pivoted into the second position.

11. A desk assembly according to claim 10, wherein the side panel and the front panel each have a beveled edge surface opposing a complimentary beveled corner post edge surface when the side panel is pivoted into the second position.

12. A desk assembly comprising:

a first and a second spaced apart support pedestal, each pedestal comprising first and second side panels and an intermediate panel that defines a forward panel of the pedestal integrally formed as a co-planar blank from plastic material, and the side panels each have a forward edge connected to first and second opposite edges of the forward panel by an elastomeric hinge portion of reduced sectional dimension and the side panels pivoting from an initial mutually coplanar relationship with the forward panel into a second position wherein the side panels extend normal to the forward panel and define therebetween with the forward panel a storage compartment;

a rearward panel connected to a rearward side of an edge panel that is connected to each of the side panels to secure the side panels in the second position; and a top work surface panel having first and second opposite ends connected to an upper surface of the side panels of each of the pedestals in a horizontal orientation, whereby the work surface panel being supported by and spanning the two pedestals.

13. A desk assembly according to claim 12, wherein at least one side panel of the pedestal has a central opening therethrough communicating with the storage compartment of the first pedestal.

14. A desk assembly according to claim 13, wherein further comprising at least one shelf panel in the first pedestal, and the side panels of the first support pedestal have attachment means affixed to an inwardly directed surface for engaging and supporting the shelf panel in a horizontal orientation within the storage compartment and the shelf panel has an upper surface that is accessible through the central opening of the first pedestal.

15. A desk assembly according to claim 14, wherein the attachment means comprising a plurality of integrally molded detents, each positioned and sized to receive an edge portion of the shelf panel therein.

16. A desk assembly according to claim 15, wherein each of the pedestals further comprising a bottom panel, and the pedestal side panels having attachment means at a lower surface for attachment to the bottom panel.

17. A desk assembly according to claim 16, wherein the bottom panel has an upper surface accessible through the central opening first pedestal.

18. A desk assembly according to claim 17, wherein each pedestal side panel having a least one protrusion projecting upward from the upper surface, and the top work surface having a lower surface and at least one downwardly open socket extending into the lower surface and receiving the side panel protrusion therein.

19. A desk assembly according to claim 18, wherein the protrusion comprising an outermost dovetail shaped flange of relatively large length and width dimension, and a connecting neck portion joined at a remote end to an underside of the dovetail flange and connected at an inward end to the side panel upper surface, and the socket having a substantially dovetail shape for receiving the dovetail flange and an upper peripheral edge surface for capturing the dovetail flange within the socket.

20. A desk assembly according to claim 19, further comprising means for attaching the rearward panel to the edge panels, the means comprising inwardly projecting protrusions on an inward facing surface of the rearward panel, and sockets formed within the rearward side of the edge panels, dimensioned and located to receive and retain the rearward panel protrusion therein.

* * * * *